US005839012A

United States Patent [19]

Miyai

[11] Patent Number: 5,839,012

[45] Date of Patent: Nov. 17, 1998

[54] FILM SPLICING DEVICE

[75] Inventor: Junichi Miyai, Wakayama, Japan

[73] Assignee: Noritsu Koki Co., Ltd., Wakayama, Japan

[21] Appl. No.: 766,609

[22] Filed: Dec. 13, 1996

[30] Foreign Application Priority Data

Dec. 15, 1995 [JP] Japan ..... 7-327546

[51] Int. Cl.[6] ..... G03D 15/04

[52] U.S. Cl. ..... 396/647; 396/620; 396/652; 242/332.4

[58] Field of Search ..... 396/612, 617, 396/620, 621, 628, 647, 651, 652; 226/91, 92; 352/235; 242/332, 332.4; 156/502

[56] References Cited

U.S. PATENT DOCUMENTS

| | | | |
|---|---|---|---|
| 4,110,774 | 8/1978 | Krehbiel et al. | 396/652 |
| 4,368,096 | 1/1983 | Kobayashi | 156/502 |
| 4,572,460 | 2/1986 | Hertrich | 242/332.4 |
| 4,720,913 | 1/1988 | Hertrich | 242/332.4 |
| 5,376,986 | 12/1994 | Long | 396/620 |
| 5,381,204 | 1/1995 | Grusetski et al. | 396/652 |
| 5,463,441 | 10/1995 | Yamaguchi | 396/620 |
| 5,475,463 | 12/1995 | Yamaguchi et al. | 396/620 |
| 5,650,033 | 7/1997 | Shimamura et al. | 156/502 |
| 5,652,941 | 7/1997 | Arimoto et al. | 396/562 |

FOREIGN PATENT DOCUMENTS

| | | |
|---|---|---|
| 0 670 520 | 9/1995 | European Pat. Off. . |
| 0 679 594 | 11/1995 | European Pat. Off. . |
| 2 085 183 | 4/1982 | United Kingdom . |

*Primary Examiner*—A. A. Mathews
*Attorney, Agent, or Firm*—Wenderoth, Lind & Ponack

[57] ABSTRACT

A film splicing device which makes it possible to easily connect a film to a leader. It has a housing having a top plate on which is provided a leader presser which is pivotable toward and away from the top surface of the top plate. The top plate has a window. A film guide is mounted in the housing under the window and has a recess that faces the window. A slide guide is coupled to the leader presser so as to be slidable into and out of the recess. With a leader placed on the top plate and pressed by the leader presser, a film end is inserted into a second hole formed in the leader, then into a film turning path defined between a curved inner surface of the recess and the slide guide, and then into a first hole formed in the leader to deform protrusions of the leader upward. When the film end is inserted until holes formed in the leading end of the film register with the tips of the protrusions, the protrusions engage in the holes. In this state, the slide guide is slid out of the recess by raising the leader presser. The film is then pulled out of the housing by raising the leader.

4 Claims, 5 Drawing Sheets

FILM SPLICING DEVICE

BACKGROUND OF THE INVENTION

This invention relates to a film splicing device for splicing films to a leader.

In order to develop a film stored in a patrone with an automatic film developing machine, the film is usually connected at its leading end to a leader and fed through the developing machine, guided by the leader.

Such a leader is made from a flexible synthetic resin sheet and is formed with holes arranged longitudinally at equal intervals and adapted to engage sprockets in the film developing unit.

If the film should come off the leader while being fed through the developing machine, it would not be fed but would stop in a developing solution. It is immensely troublesome to rescue such film. A clumsy operator may expose the film to light while taking it out of the developing machine. Thus, the film must be securely connected to the leader.

Film is usually coupled to a leader by means of a splicing tape. But it is troublesome to apply splicing tape and peel it off after the film has been developed. In order to couple a film to a leader by means of splicing tape with high positional accuracy, a special workbench for splicing is needed. Also, use of splicing tape is economically undesirable because it is not recyclable.

To solve these problems, the applicant of this invention proposed a film-leader coupling structure shown in FIG. 7 (in Japanese Patent Application 7-168783).

This coupling structure includes a first hole 2 and a second hole 3 formed in a leader at its rear end with respect to the feed direction of the leader, with the latter being spaced rearwardly from the former. Protrusions 4 extend from the front edge of the hole 2 rearwardly across the hole 2 and rest on the portion of the leader along the rear edge of the hole 2. Each film 5 has holes 6 at its leading end which can receive the protrusions 4. The leading end of the film 5 is inserted into the second hole 3 from the upper side of the leader, and then into the first hole 2 from the underside of the leader to engage the protrusions 4 in the holes 6.

Thus, the film 5 can be easily coupled to the leader 1 with high positional accuracy.

Since the protrusions 4 extend in the opposite direction to the feed direction of the leader 1, they will never be caught by anything while the leader is fed through the film feed path in the developing machine. Side edges of the first and second holes 2 and 3 prevent lateral movement of the film 5, so that film can be fed straight without meandering.

An object of this invention is to provide a film splicing device which can easily couple a film to a leader.

SUMMARY OF THE INVENTION

According to this invention, there is provided a film splicing device for slicing a film to a leader, the device comprising a housing having a top plate on which the leader is placed, a leader presser provided on the top plate so as to be pivotable toward and away from the top surface of the top plate for pressing the leader against the top plate, the top plate being formed with a window, a film guide mounted in the housing under the window and having a recess opposite to the window, a slide guide mounted in the housing so as to be slidable into and out of the recess and to define a film turning path between its outer periphery and the inner wall of the recess when the slide guide is slid into the recess, and a linkage means for coupling the leader presser to the slide guide such that when the leader presser is pivoted down onto the top surface of the top plate, the slide guide slides into the recess, and when the presser is raised from the top plate, the slide guide slides out of the recess.

Other features and objects of the present invention will become apparent from the following description made with reference to the accompanying drawings, in which:

DETAILED DESCRIPTION OF THE PREFERRED EMBODIMENT

An embodiment of this invention will now be described with reference to the drawings.

Figure 1:
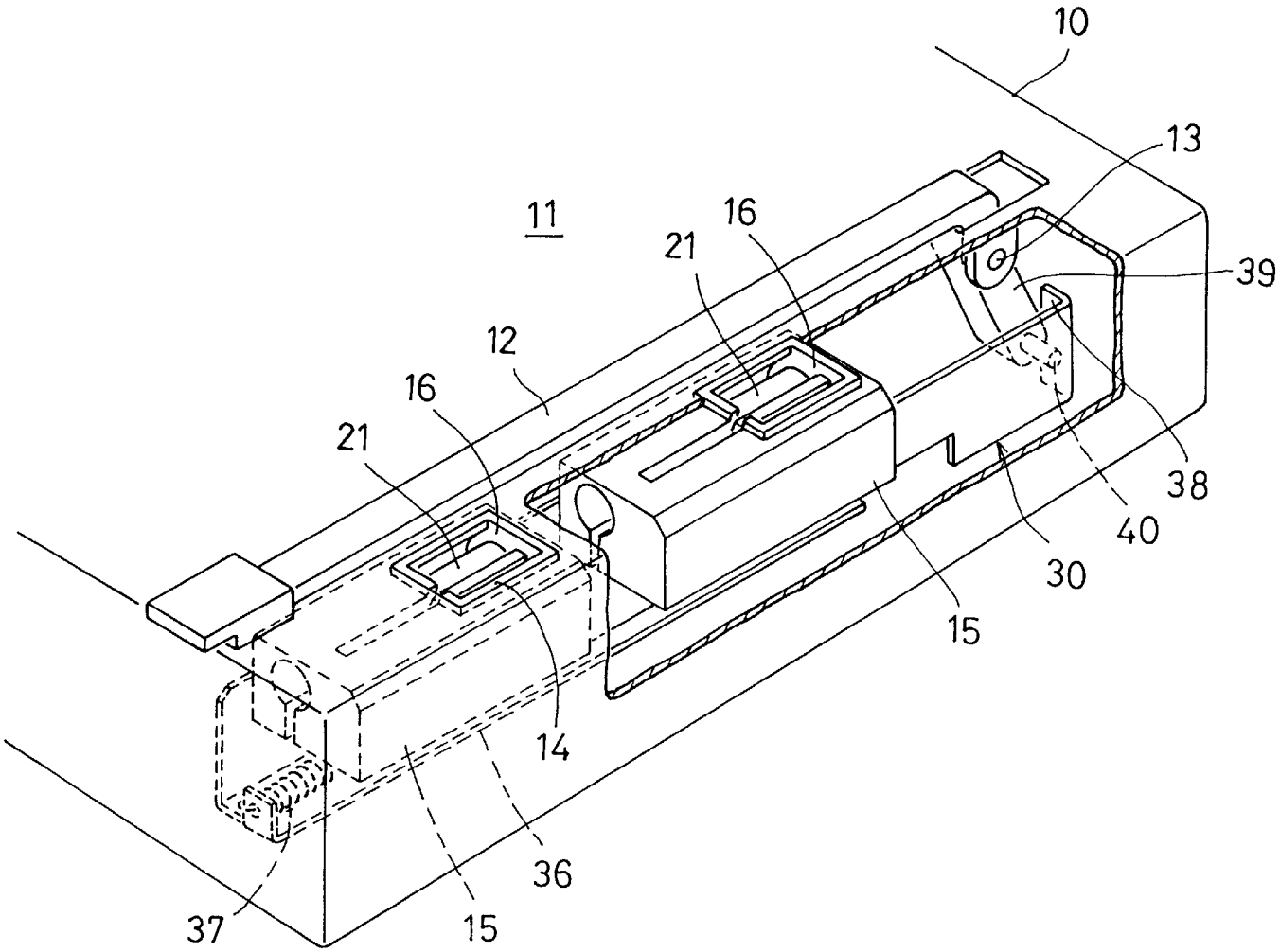
FIG. 1 is a perspective view of the film splicing device according to this invention.
Figure 2:
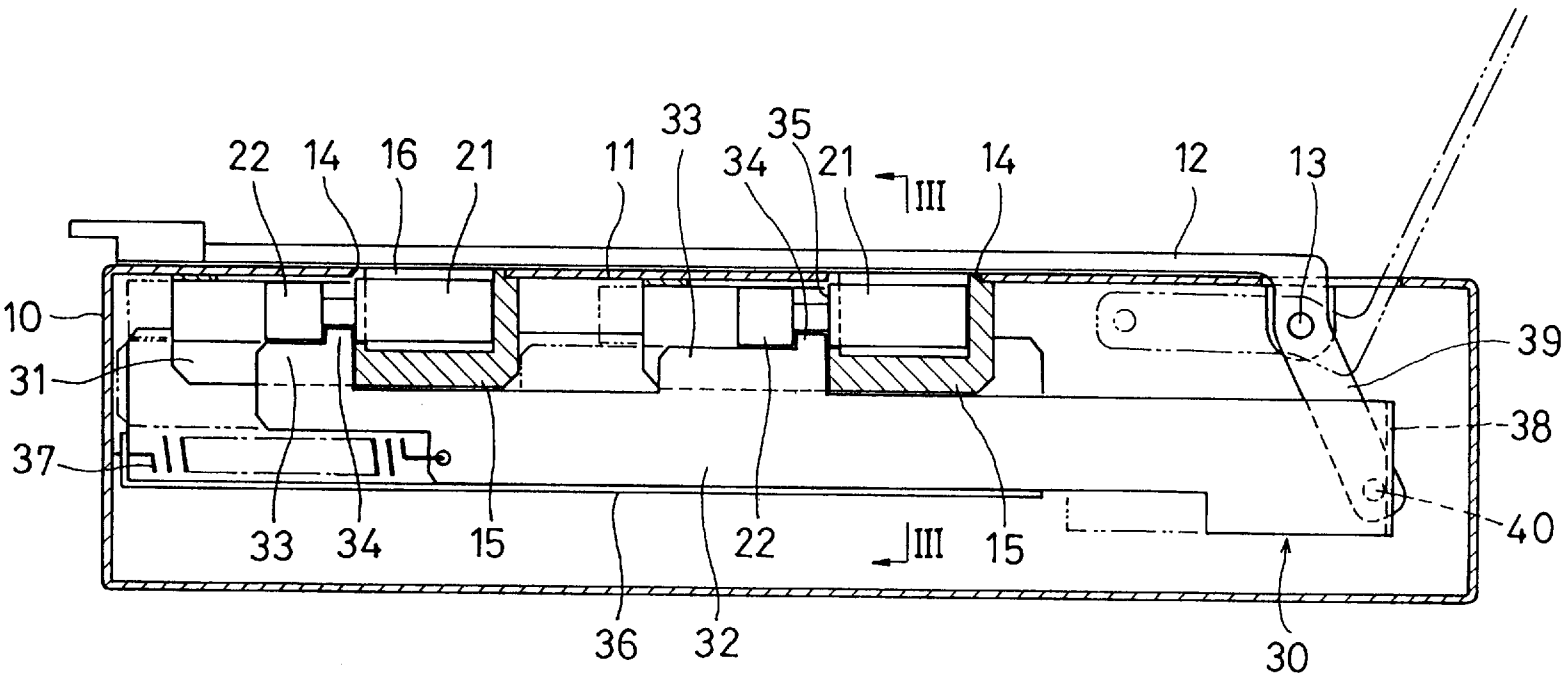
FIG. 2 is therefore vertical section.

As shown in FIGS. 1 and 2, the splicing device has a box-shaped housing 10 having a top plate 11 on which is provided a strip shaped leader presser 12. The leader presser 12 has a bent rear end through which is inserted a pin 13 about which the presser 12 is pivotable (FIG. 2).

Two windows 14 are formed in the top plate 11 along the leader presser 12 where it rests on the top plate. A film guide 15 is provided under each window 14 and is screwed or otherwise fixed to the front plate of the housing 10.

Figure 3:
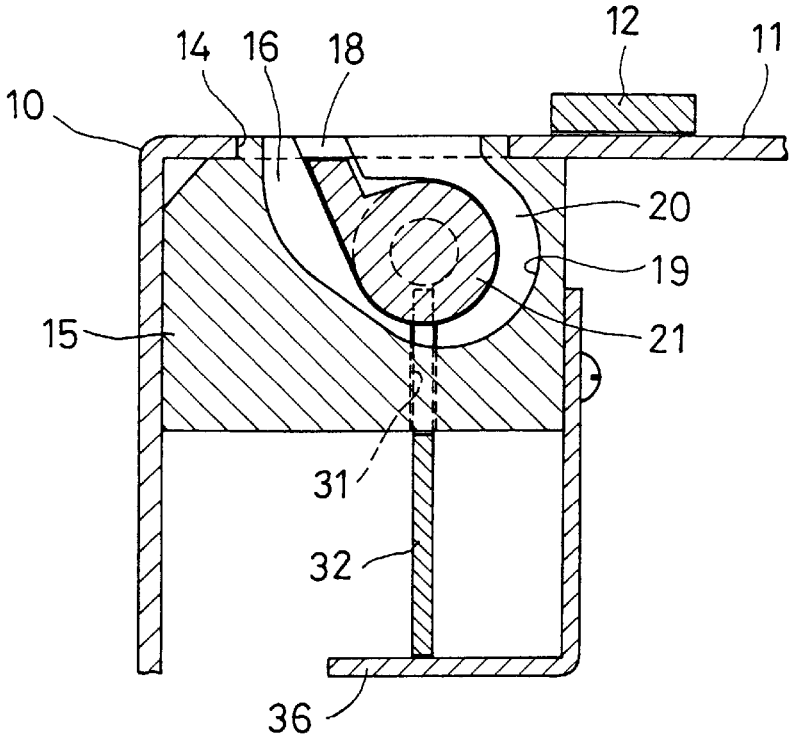
FIG. 3 is a sectional view taken along line III—III of FIG. 2.
Figure 4:
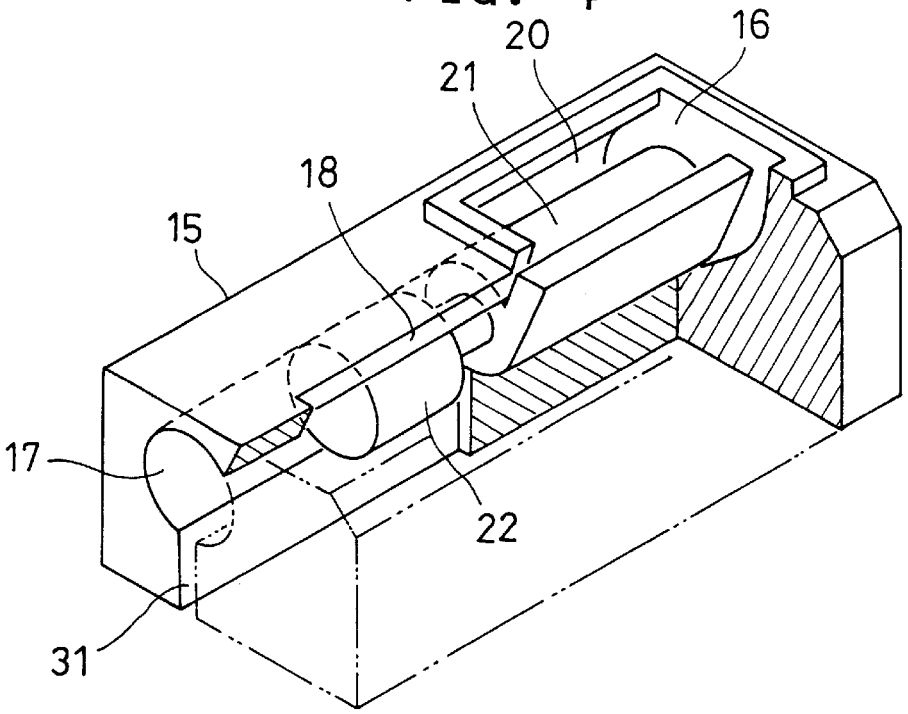
FIG. 4 is a partially cutaway perspective view of a film guide and slide guide.
Figure 5:
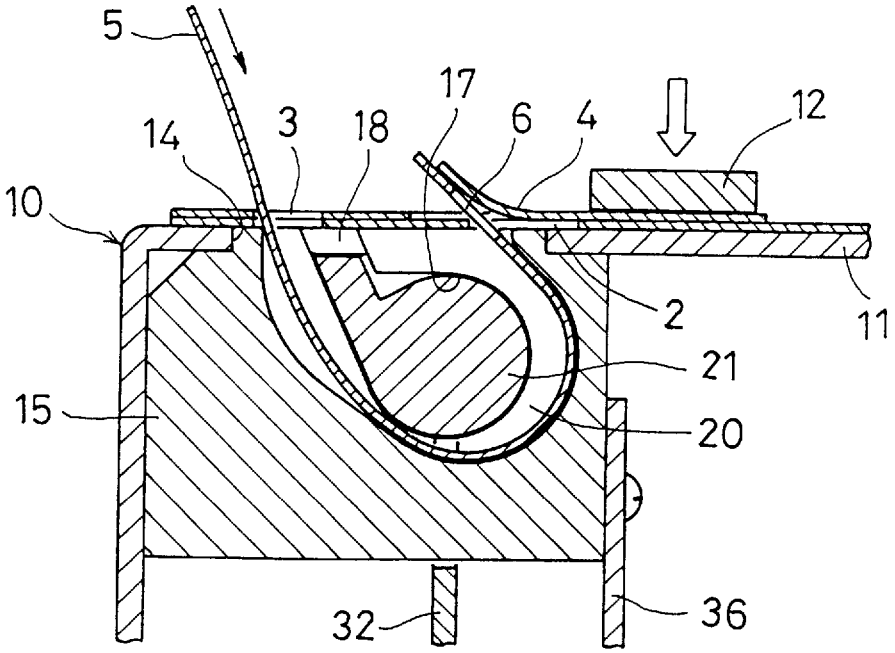
FIG. 5 is a sectional view showing how a film is coupled to a leader.

As shown in FIGS. 2–4, each film guide 15 is formed with a recess 16 facing one of the windows 14. A guide hole 17 extends from one side of the recess 16 to the side of the film guide. A guide groove 18 extends from the one side of the recess 16 along the guide hole 17.

Figure 7:
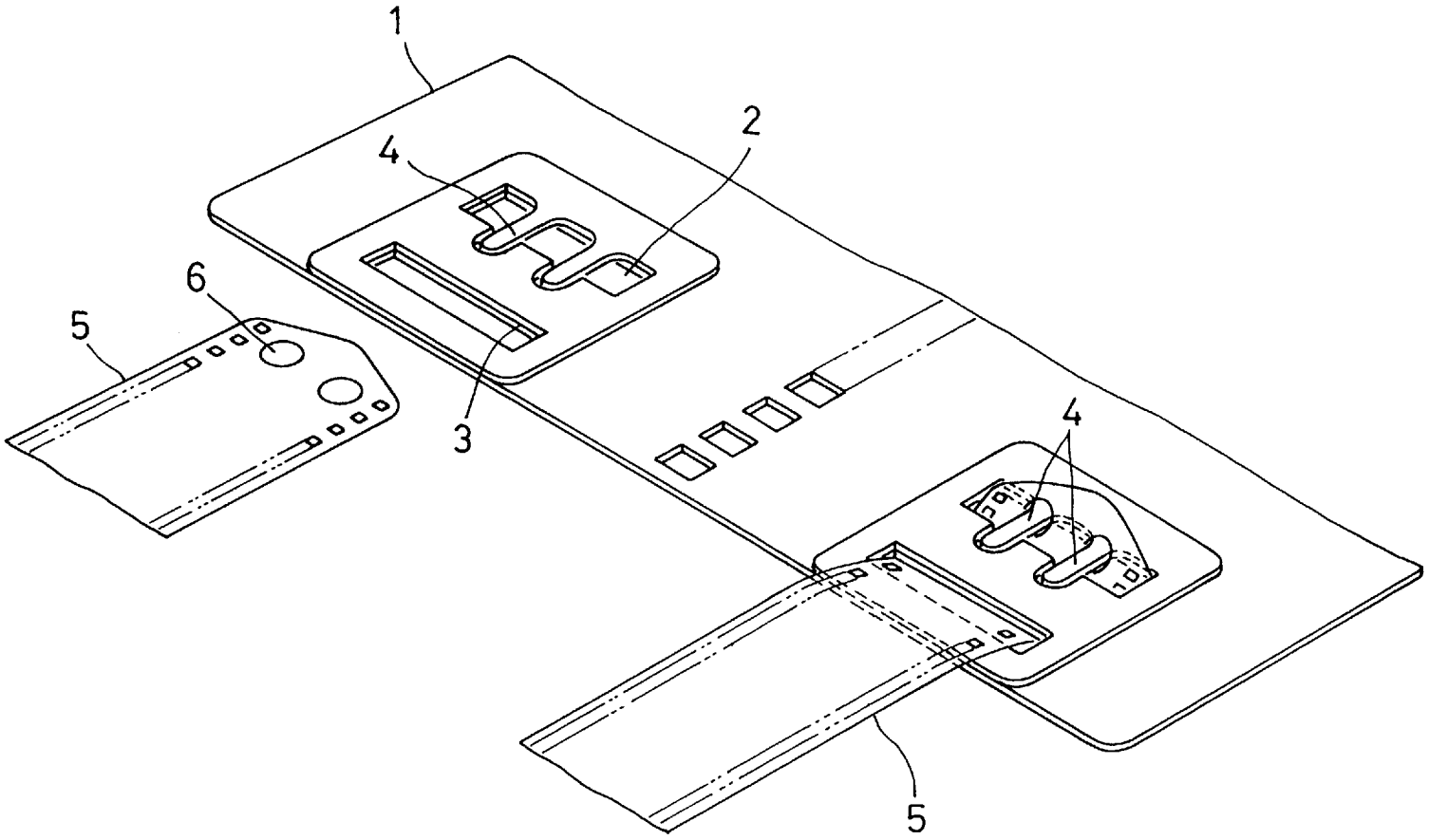
FIG. 7 is a perspective view showing how a film is coupled to a leader.

The width of the recess 16 is determined so that the film 5 shown in FIG. 7 can be inserted. Its front and rear edges are spaced by a distance slightly larger than the distance between the front edge of the first hole 2 and the rear edge of the second hole 3 of the leader 1 shown in FIG. 7.

The recess 16 has a curved inner surface 19. A slide guide 21 is retractably inserted in the recess 16. When it is in the recess, the guide 21 defines a film turning path 20 in cooperation with the curved surface 19 of the recess 16.

The slide guide 21 is slidable along the guide hole 17 and guide groove 18 formed in the film guide 15. It has a guide shaft 22 provided on one side thereof and slidable in the guide hole 17.

The width of the guide 21 is determined so that it protrudes slightly into the guide hole 17 and guide groove 18 when fully inserted into the recess 16.

The slide guide 21 of each film guide 15 is coupled to the leader presser 12 through a linkage 30 so that when the presser is pivoted down onto the top plate 11, the slide guide is pushed into the recess 16 and when the presser is raised off the top plate, the slide guide retracts from the recess 16.

The linkage 30, shown in FIG. 2, includes a slide plate 32 having ribs 33 formed on its top edge and received in transverse slits 31 formed in the bottoms of the film guides 15. Each rib 33 has a protrusion 34 engaged in a groove 35 formed in the guide shaft 22 of each slide guide 21. The slide plate 32 is slidably supported on an Lshaped guide plate 36 mounted to the film guides 15. A spring 37 is coupled to the slide plate 32 to bias the latter to retract the slide guides 21 from the respective recesses 16.

The slide plate 32 has a bent rear end 38 which is kept in engagement with a pin 40 provided on a protrusion 39 provided at the pivoting end of the leader presser 12. When the presser 12 is pivoted down onto the top plate 11, the pin 40 pushes the bent rear end 38 to slide the slide plate 32 to push the guides 21 into the respective recesses 16.

To couple the films 5 shown in FIG. 7 to the leader 1 with the film splicing device of the invention, the leader 1 is placed on the top plate 11 of the housing 10 so that its two pairs of first and second holes 2 and 3 register with the respective recesses 16 of the film guides 15.

For easy positioning of the leader 1, positioning rulers for positioning the front and side edges of the leader 1 may be provided on the top plate 11.

After setting the leader 1 in position, the leader presser 12 is tipped down to the top plate 11. The pin 40 thus pushes the bent end 38 of the slide plate 32, so that the slide guides 21 are pushed into the recesses 16. When the guides 21 are fully pushed thereinto, the film turning path 20 is defined in each recess 16 between curved surface 19 and the guide 21.

With the leader presser 12 pressing against the leader 1, a film 5 is pushed through the second hole 3 from one side of the leader into the film turning path 20. As the film is further pushed in, its end turns by 180° along the film turning path 20 and is guided into the first hole 2.

When the end of the film 5 is guided into the first hole 2, the protrusions 4 of the leader 1 are pushed up by the end of the film 5. When the film is pushed in and its holes 6 face the ends of the protrusions 4, the latter will resiliently deform back into original position and engage in the holes 6. The other film is coupled to the leader in the same manner.

Figure 6:
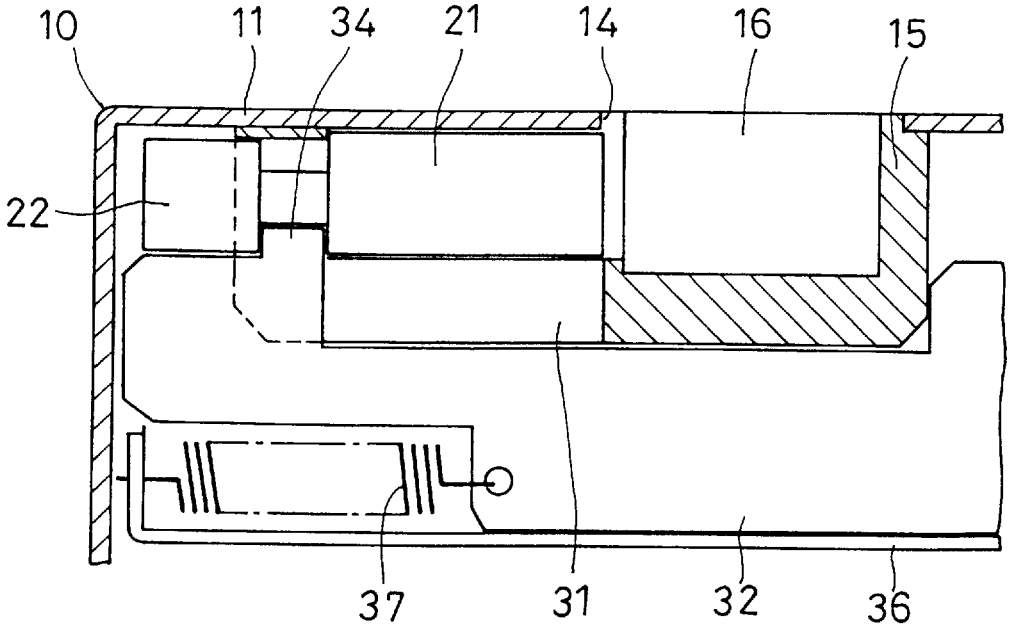
FIG. 6 is a sectional view of the slide guide in a retracted position.

By raising the leader presser 12 with the protrusions 4 engaging in the holes 6, the slide plate 32 will be moved leftwardly in FIG. 2, biased by the spring 37, so that the slide guides 21 retract from the recesses 16 as shown in FIG. 6.

By raising the leader 1, the films 5 are raised together with the leader, until the U-shaped slack ends of the films 5 disappear. The films are now securely coupled to the leader with high positional accuracy.

In the illustrated embodiment, two films 5 are coupled to a leader 1. But a single film 5 may be connected to a single leader 1. In such case, a single window 14 may be formed in the top plate 11 of the housing 10, instead of two.

According to this invention, with the leader placed on the housing and pressed by the leader presser, the end of each film is inserted in a first hole of the leader. The film is thus easily coupled to the leader.

Since the leader is pressed by the leader presser, it will never be pushed up when films are coupled to the leader. Films can thus be coupled to the leader with high accuracy and reliability.

By pivoting the leader presser, the slide guides are moved into and out of the recesses, so that it is possible to take out films coupled to the leader without fail.

What is claimed is:

1. A film splicing device for slicing a film to a leader, said device comprising a housing having a top plate on which the leader is to be placed, a leader presser provided on said top plate so as to be pivotable toward and away from the top surface of said top plate for pressing the leader against said top plate, said top plate being formed with a window, a film guide mounted in said housing under said window and having a recess opposite to said window, a slide guide mounted in said housing so as to be slidable into and out of said recess, and to define a film turning path between its outer periphery and an inner wall of said recess when said slide guide is slid into said recess, and a linkage means for coupling said leader presser to said slide guide such that when said leader presser is pivoted down onto the top surface of said top plate, said slide guide slides into said recess, and when said presser is raised from said top plate, said slide guide slides out of said recess.

2. A film splicing device as claimed in claim 1 wherein said top plate is formed with a pair of said windows along said leader presser when it is laid flat on the top surface.

3. A film splicing device as claimed in claim 1 wherein said linkage means comprises a transverse slit formed in the bottom of said film guide, a slide plate coupled to said slide guide so as to be slidable along said slit, a spring biasing said slide plate in such a direction that said slide guide slides out of said recess, a bent portion provided at a rear end of said slide plate, a protrusion provided at one end of said leader presser about which said presser pivots, and a pin provided on said protrusion for biasing said bent portion in such a direction that said slide guide slides into said recess.

4. A film splicing device as claimed in claim 2 wherein said linkage means comprises a transverse slit formed in the bottom of said film guide a slide plate coupled to said slide guide, so as to be slidable along said slit, a spring biasing said slide plate in such a direction that said slide guide slides out of said recess, a bent portion provided at a rear end of said slide plate, a protrusion provided at one end of said leader presser about which said presser pivots, and a pin provided on said protrusion for biasing said bent portion in such a direction that said slide guide slides into said recess.

* * * * *